US007599642B2

(12) United States Patent
Nakajima et al.

(10) Patent No.: US 7,599,642 B2
(45) Date of Patent: Oct. 6, 2009

(54) IMAGE FORMING APPARATUS INCLUDING A HEATER POSITIONED BETWEEN A PHOTOSENSITIVE MEMBER AND A CORONA CHARGER

(75) Inventors: Masanobu Nakajima, Toride (JP); Takahiro Nakase, Toride (JP); Naoyuki Yamamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/836,983

(22) Filed: Aug. 10, 2007

(65) Prior Publication Data

US 2008/0038011 A1 Feb. 14, 2008

(30) Foreign Application Priority Data

Aug. 14, 2006 (JP) ..... 2006-221001

(51) Int. Cl.
*G03G 15/02* (2006.01)

(52) U.S. Cl. ..... 399/100; 399/94

(58) Field of Classification Search ..... 399/91, 399/100, 98, 94, 93
See application file for complete search history.

(56) References Cited

U.S. PATENT DOCUMENTS 4,607,936 A 8/1986 Miyakawa et al. ..... 355/3 DR
5,422,462 A 6/1995 Kishimoto ..... 219/545
5,689,768 A * 11/1997 Ehara et al. ..... 399/96

FOREIGN PATENT DOCUMENTS

JP 57189155 A * 11/1982
JP 59077474 A * 5/1984
JP 60-073633 4/1985
JP 03174165 A * 7/1991
JP 6-167857 6/1994
JP 6-295780 10/1994
JP 2003076118 A * 3/2003
JP 2003-109803 4/2003

OTHER PUBLICATIONS

English-language translation of JP 60-73633 A.
English-language translation of JP 2003-76118 A.

* cited by examiner

*Primary Examiner*—Quana M Grainger
(74) *Attorney, Agent, or Firm*—Fitzpatrick, Cella, Harper & Scinto

(57) ABSTRACT

An image forming apparatus is constituted by an image bearing member; a corona charging member including a wire; a heat generating member for generating heat by energization; a shielding member, including the heat generating member, capable of shielding a portion of the corona charging member opposing to the image bearing member from the image bearing member by being moved between the corona charging member and the image bearing member; an energization control member for controlling energization of the heat generating member; and moving member for moving the shielding member to a first position at which the shielding member shields the portion and a second position retracted from the first position. When the shielding member is located at the first position, at least a part of the heat generating member is disposed between the corona charging member and the image bearing member.

2 Claims, 9 Drawing Sheets

IMAGE FORMING APPARATUS INCLUDING A HEATER POSITIONED BETWEEN A PHOTOSENSITIVE MEMBER AND A CORONA CHARGER

FIELD OF THE INVENTION AND RELATED ART

The present invention relates to an image forming apparatus such as a printer, a copying machine, a facsimile apparatus, or a multi-function machine, particularly an image forming apparatus including a corona charger.

Generally, in an image forming apparatus using electrophotography, a corona charger (corotron, scorotron) is utilized as a voltage application means for electrically charging and discharging an electrophotographic photosensitive member. The corona charger is constituted by a wire electrode (a metal wire such as gold-plated tungsten having a diameter of 50-100 μm) and a shield plate. The corona charger electrically charges and discharges the photosensitive member by applying a high voltage (about 4-8 kV) to the wire electrode.

The corona charger produces ozone ($O_3$) when (corona) discharge is effected, so that the ozone oxidizes nitrogen in the air to produce nitrogen oxides (NOx), which further produces nitric acid or the like by reacting with moisture (water content) in the air. These corona discharge products such as nitrogen oxides, nitric acid, and the like are deposited and accumulated on the photosensitive member and its peripheral equipment, so that surfaces of these members can be contaminated. For example, in the case where the image forming apparatus is mounted in a high-humidity environment, the corona discharge products are high in moisture absorbency, so that the surface of the photosensitive member causes a lowering in electric resistance by moisture absorption by the deposited corona discharge products to be lowered in electric charge holding ability wholly or partially. When such a lowering in electric resistance is caused to occur, a normal electrostatic latent image at a normal electric potential as shown in FIG. 13(*a*) cannot be formed but as shown in FIG. 13(*b*), an electrostatic latent image pattern is broken or is not formed due to leakage of electric charges at the photosensitive member surface in a planer direction. As a result, normal image formation as shown in FIG. 12(*a*) cannot be effected but an image defect called an image blur or an image flow as shown in FIG. 12(*b*) is caused to occur.

Particularly, the corona discharge product deposited on an inner surface of the shield plate of the corona charger is vaporized and liberated during not only an operation of the image forming apparatus but also a quiescent operation for a long time such as during the night, so that the corona discharge product is deposited on the photosensitive member surface in the neighborhood of a discharge opening of the corona charger. For this reason, after the quiescent operation for a long time, moisture absorption further proceeds, so that the lowering in electric resistant at a moisture absorption portion on the surface of the photosensitive member is in an advanced stage. Accordingly, in image formation on a first sheet or several tens of sheets after the long-time quiescent operation, the image flow is liable to occur in an area corresponding to the opening of the corona charger during the quiescent operation. Such a phenomenon is noticeable in image forming apparatuses using an AC (alternating current) type corona charger or a negative charging scheme for a photosensitive member (a scheme using a positively chargeable toner).

Japanese Laid-Open Patent Application (JP-A) Sho 60-73633 has proposed such a constitution that the surface of the photosensitive member is heated for preventing the above-described moisture absorption at the photosensitive member surface and the opening of the corona charger is shielded with a shielding film. In the method in which the photosensitive member is heated from the inside thereof, it takes time to increase a temperature of the photosensitive member surface to 40° C. or more required for countermeasures to the image flow during, e.g., warming-up or rise time, so that the photosensitive member may preferably be heated from the outside thereof. Further, it can be considered that the photosensitive member is warmed in advance in order to heat and dry the photosensitive member surface so as not to cause the image flow in a short rise time, but there arises a problem of a waste of energy consumption.

In the constitution proposed in JP-A Sho 60-73633, a heating roller is provided at a position spaced apart from a portion at which a large amount of the discharge product is deposited, i.e., an opposing surface with respect to the corona charger, so that it takes time to sufficiently heat the opposing surface. Further, in the constitution, the opposing surface is heated through heat conduction by heating a portion other than the opposing surface, so that it is necessary to heat an unnecessary portion, thus resulting in a large electric power consumption.

SUMMARY OF THE INVENTION

A principal object of the present invention is to provide an image forming apparatus capable of not only reducing an amount of deposition of an electric discharge product on an image bearing member but also heating a surface of the image bearing member at a portion opposing a corona charger.

According to an aspect of the present invention, there is provided an image forming apparatus comprising:

an image bearing member;

a corona charging member including a wire;

a heat generating member for generating heat by energization;

a shielding member, including the heat generating member, capable of shielding a portion of the corona charging member opposing to the image bearing member from the image bearing member by being moved between the corona charging member and the image bearing member;

energization control means for controlling energization of the heat generating member; and moving means for moving the shielding member to a first position at which the shielding member shields the portion and a second position retracted from the first position, wherein when the shielding member is located at the first position, at least a part of the heat generating member is disposed between the corona charging member and the image bearing member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

First Embodiment

A First Embodiment of the present invention will be described with reference to FIGS. 1 to 6.

Figure 1:
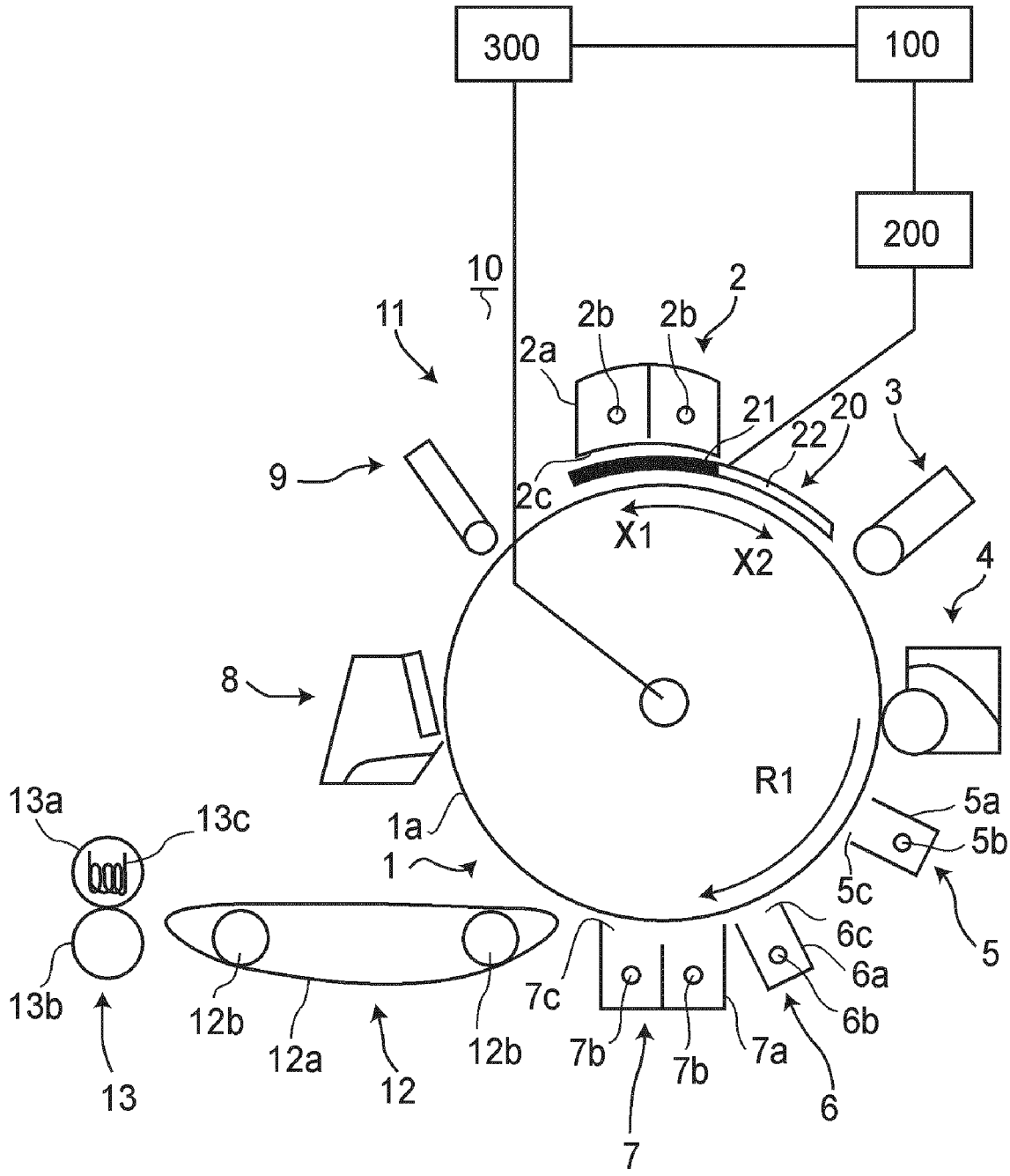
FIG. 1 is a schematic sectional view showing an image forming apparatus according to First Embodiment.
Figure 2:
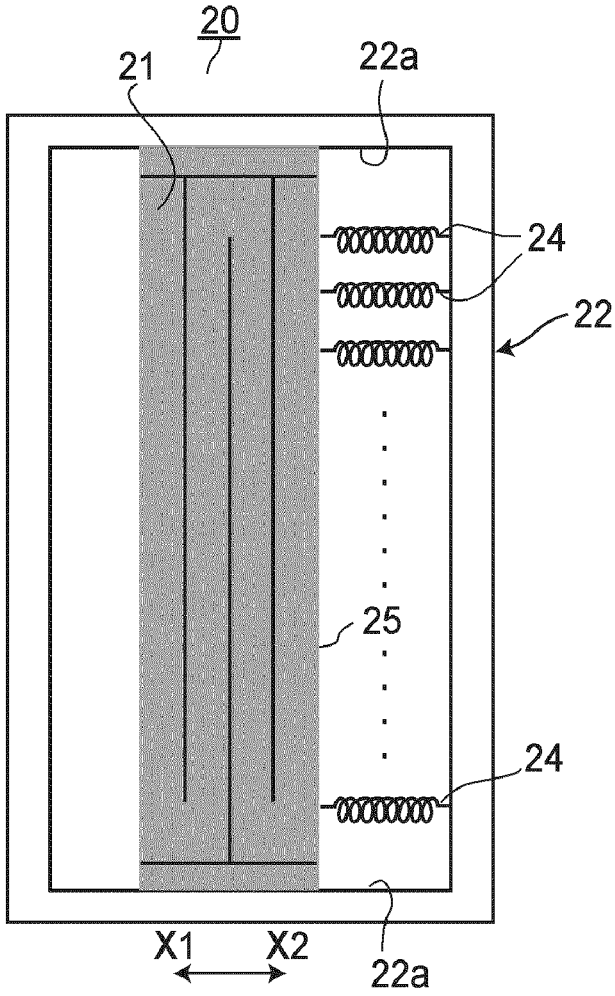
FIG. 2 is a plan view showing a heat shielding apparatus according to a First Embodiment of the present invention.
Figure 3:
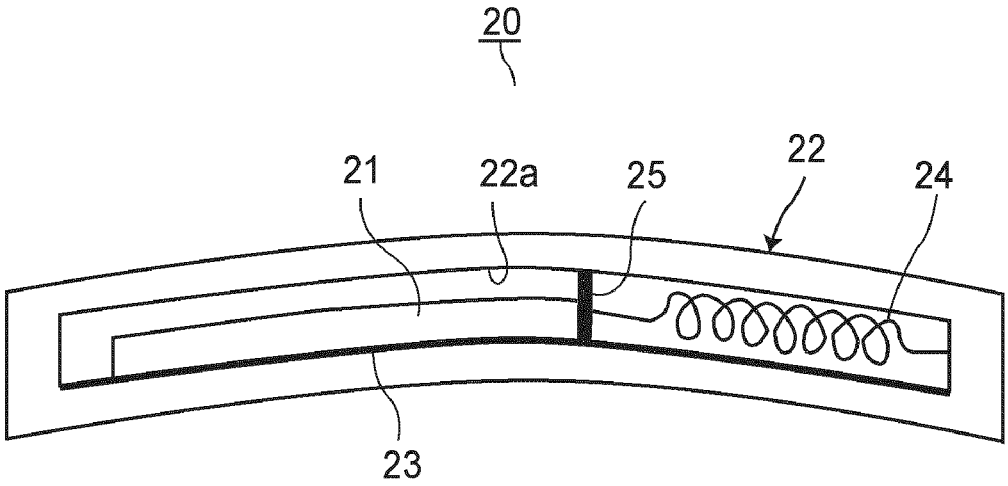
FIG. 3 is a sectional view showing the heat shielding apparatus according to the First Embodiment.
Figure 4:
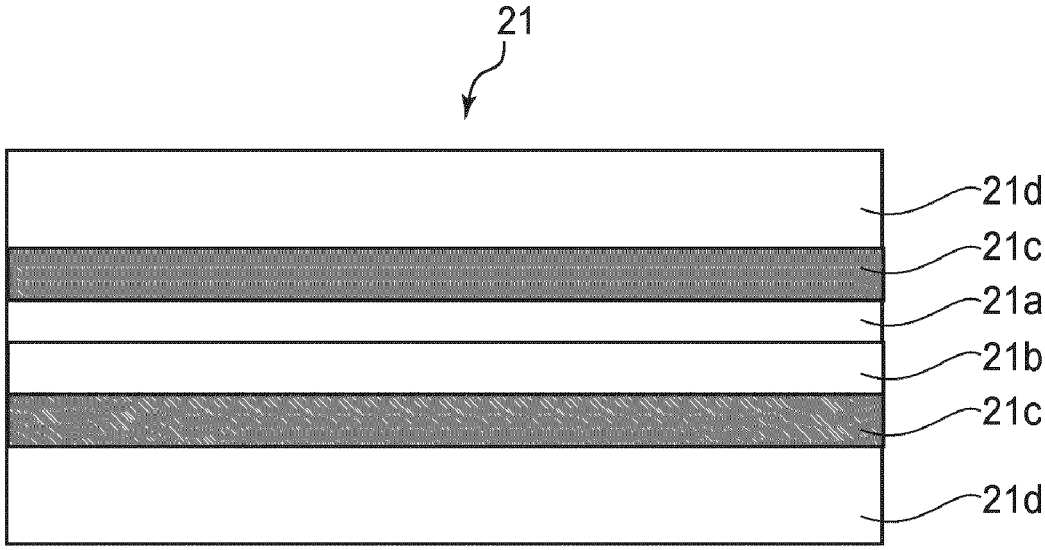
FIG. 4 is a schematic sectional view showing a constitution of a PTC (positive temperature coefficient (of resistance)) heater.
Figure 5:
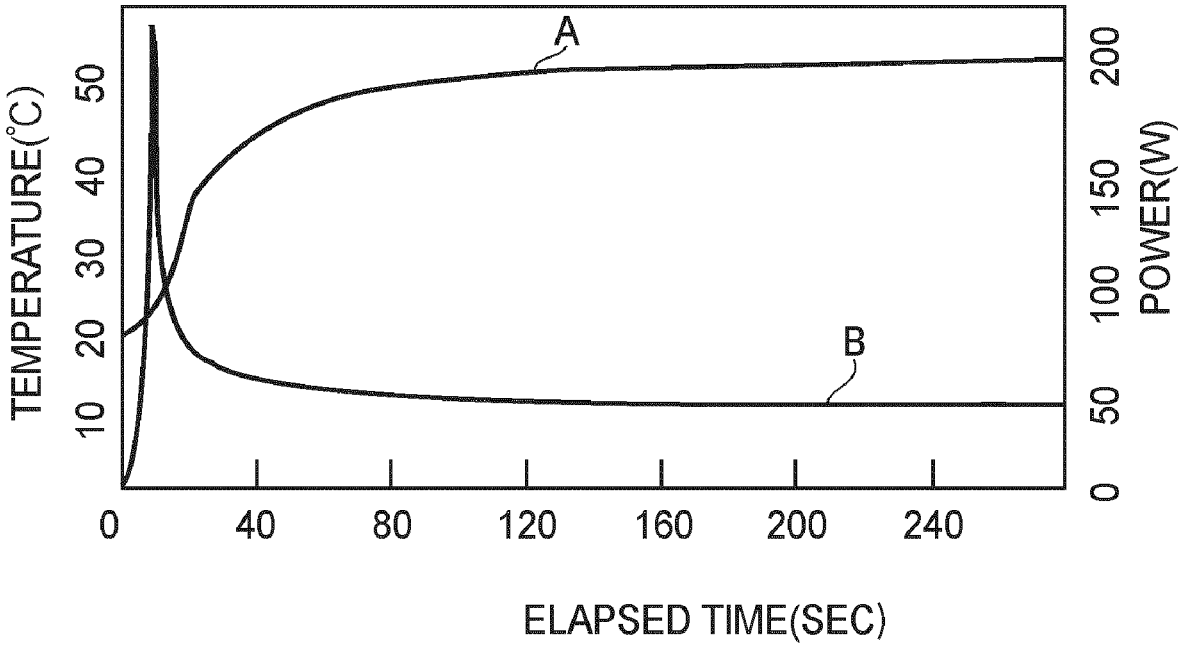
FIG. 5 is a time chart showing changes in temperature and electric power.
Figure 6:
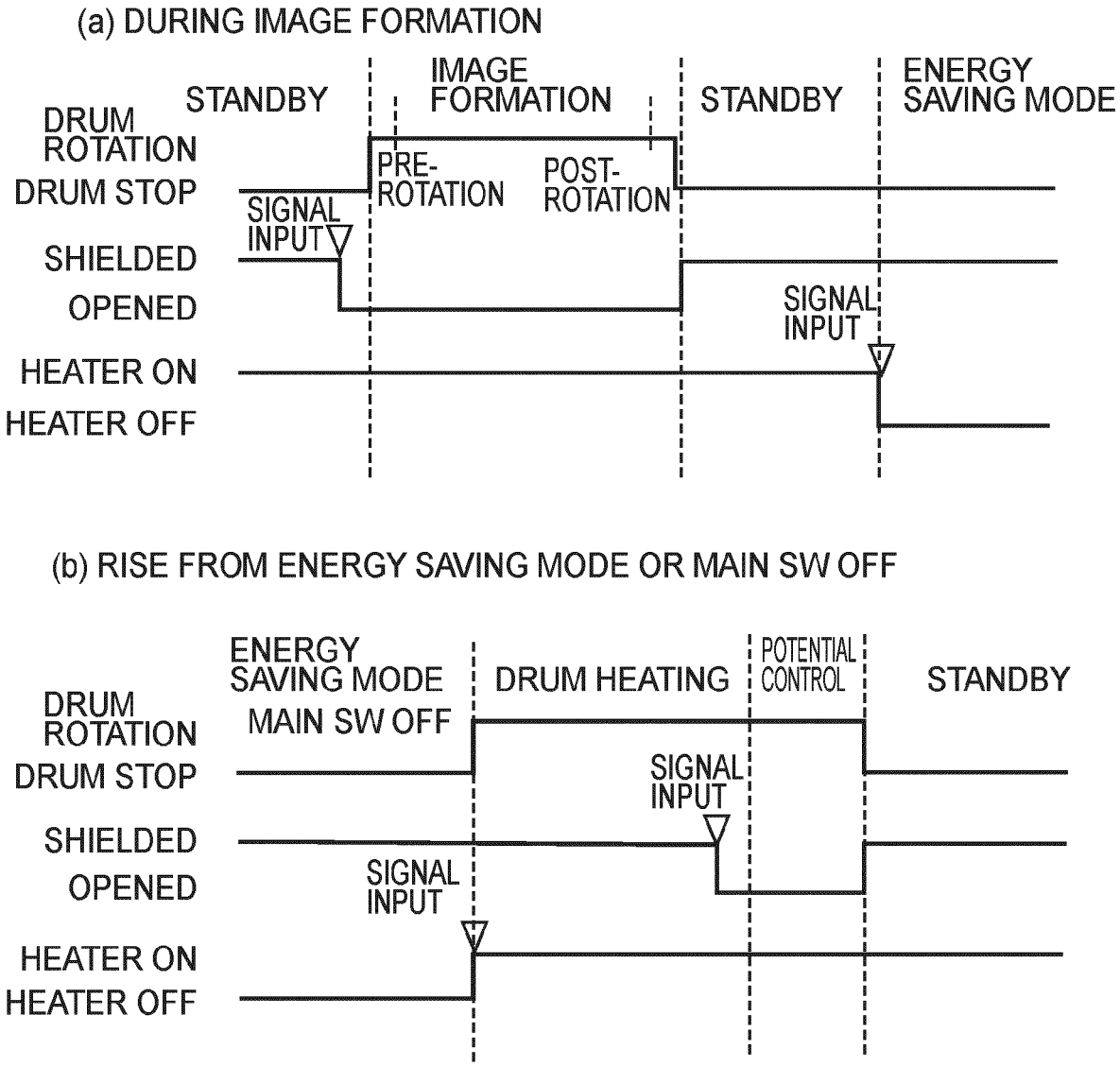
FIGS. 6(*a*) and 6(*b*) are diagrams for illustrating operations of the heat shielding apparatus, wherein FIG. 6(*a*) is a time chart during image formation and FIG. 6(*b*) is a time chart during warming-up.

FIG. 1 is a schematic sectional view showing an image forming apparatus according to the First Embodiment. FIG. 2 is a plan view showing a heat shielding apparatus according to the First Embodiment. FIG. 3 is a sectional view showing the heat shielding apparatus according to the First Embodiment. FIG. 4 is a schematic sectional view showing a constitution of a PTC heater. FIG. 5 is a time chart showing changes in temperature and electric power. FIGS. 6(*a*) and 6(*b*) are diagrams for illustrating operations of the heat shielding apparatus, wherein FIG. 6(*a*) is a time chart during image formation and FIG. 6(*b*) is a time chart during warming-up.

First, a schematic general arrangement of an electrophotographic image forming apparatus to which the present invention is applicable will be described.

As shown in FIG. 1, in the image forming apparatus, an image forming portion includes a transfer portion 11 for transferring a toner image onto a recording material, a fixing portion 13 for fixing the toner image transferred onto the recording material, and a conveying portion 12 for conveying the recording material from the transfer portion 11 to the fixing portion 13. Examples of the recording material may include paper such as plain paper or postcard paper and a transparent sheet such as an OHP sheet.

The transfer portion includes a photosensitive member 1 as an image bearing member (hereinafter referred to as a "photosensitive drum"). The photosensitive drum 1 is rotatably supported by a main assembly (not shown) of the image forming apparatus in a direction indicated by an arrow R1 and is rotationally controlled by control of a drum driving apparatus of a photosensitive drum unit on the basis of an instruction from a drive control portion 100. The drum driving apparatus includes the drive control portion 100 and a driving motor 300 connected to the drive control portion 100 and by drive of the driving motor 300, the photosensitive drum 1 is rotationally driven. Around the photosensitive drum 1, a primary charger 2, an exposure apparatus 3, a developing apparatus 4, a pre-transfer charger 5, a transfer charger 6, a separation charger 7, a cleaning apparatus 8, and a pre-exposure device 9 are disposed substantially in this order along a rotational direction of the photosensitive drum 1. In this embodiment, the corona charger is used as the primary charger 2, the pre-transfer charger 5, the transfer charger 6, and the separation charger 7.

For example, the primary charger 2 is formed in a substantially rectangular solid shape and constituted by a shielding plate (shield) 2*a* having an opening 2*c* opened toward a surface 1*a* of the photosensitive drum 1 and two wire electrodes (wires) 2*b* and 2*b* stretched in a rotational axis direction of the photosensitive drum 1. Further, the pre-transfer charger 5, the transfer charger 6, and the separation charger 7 and constituted substantially similarly as the primary charger 2. More specifically, each of the chargers 5, 6 and 7 is constituted by a shielding plate 5*a*, 6*a* or 7*a* having an opening 5*c*, 6*c* or 7*c* and wire electrodes 5*b*, 6*b* or 7*b*.

In this embodiment, of these chargers 2, 5, 6 and 7, a heat shielding apparatus 20, which will be described later specifically, is provided between the opening 2*c* of the primary charger 2 and an opposing portion of the surface 1*a* (image bearing member surface) of the photosensitive drum 1.

The conveying portion 12 includes a conveying belt 12*a* extended around a plurality of rollers 12*b* including at least one roller driven as a driving roller for rotationally driving the conveying belt 12*b* to convey the recording material on the conveying belt 12*b*. The fixing portion 13 includes a fixing roller 13*a* containing therein a heating device 13*c* and a pressing roller 13*b* which is always urged against the fixing roller 13*a*.

In the above-described image forming apparatus, during image formation, the photosensitive drum 1 is rotationally driven at a predetermined process speed (peripheral speed) in the arrow R1 direction by the driving motor on the basis of the control by the control portion. The surface of the photosensitive drum 1 is electrically charged uniformly to a predetermined polarity and a predetermined potential by the primary charger 2. The surface of the photosensitive drum 1 after electrical charging is irradiated with light on the basis of image information by the exposure apparatus 3, so that electric charges at an irradiation portion are removed to form an electrostatic latent image. The electrostatic latent image is developed, with a developer, as a toner image by attaching toner thereto. As the developer, it is possible to use, e.g., a non-magnetic, one component developer.

The thus formed toner image on the photosensitive drum 1 reaches a transfer position between the photosensitive drum 1 and the transfer charger 6 by the rotation of the photosensitive drum 1 in the arrow R1 direction.

The recording material is sent to the transfer position so as to be timed with the toner image, and the toner image on the photosensitive drum 1 is transferred onto the recording material by an electrostatic force generated between the photosensitive drum 1 and the transfer charger 6 by the transfer charger 6 to which a transfer bias of an opposite polarity to that of the toner image is applied.

The recording material after the toner image is transferred is separated from the photosensitive drum 1 by the separation charger 7 to which the separation bias is applied, and is sent onto the conveying belt 12*a* and conveyed to the fixing portion 13 by the conveying belt 12*a*. The recording material conveyed to the fixing portion 13 is heated and pressed during passage thereof between the fixing roller 13*a* and the pressing roller 13*b* to fix thereon the toner image and is discharged out of the image forming apparatus.

Transfer residual toner, remaining on the surface of photosensitive drum 1 after the toner image transfer, which has not been transferred during the toner image transfer is removed by the cleaning apparatus, and electric charges remaining on the photosensitive drum surface are removed by the pre-exposure device 9, so that the image forming apparatus is subjected to subsequent image formation.

Next, the heat shielding apparatus (shielding member driving apparatus) 20 as an essential portion of the present invention will be specifically described. The heat shielding apparatus 20 in this embodiment is constituted by a door-like heater 21 as a shielding member having a heat generating portion, a heater frame 22, and a sliding drive means 200 as shown in FIGS. 1 to 3. An operation between a shielding position (first position) by the sliding drive means 200 and a retracted position (second position) which is a position retracted from the shielding position is controlled by the control portion 100 such as a CPU.

The heat frame 22 is disposed between the photosensitive drum 1 and the primary charger 2 as shown in FIG. 1 and fixedly supported by an unshown main assembly of the image forming apparatus. The heater frame 22 has a size, as shown in FIG. 2, such that a length of a heater portion is larger than a length of the opening 2*c* of the primary charger 2 with respect to a movement direction of the door-like heater 21 as specifically described later. At both end portions of the heater frame 22 with respect to the rotational axis direction of the photosensitive drum 1, as shown in FIG. 3, a guide hole 22*a* is formed so that the door-like heater 21 is slidably supported in the guide hole 22*a* at both end portions. Accordingly, by the sliding operation of the door-like heater 21, a portion between the surface of the photosensitive drum 1 and the opening 2*c* of the primary charger 2 can be shielded and opened. Further, at a lower surface of the guide hole 22*a*, an electrode 23 for supplying electric power to the door-like heater 21 is disposed over the sliding direction. As a result, even when the door-like heater 21 is slidably moved, electric power can be supplied to the door-like heater.

The door-like heater 21 has a size capable of covering the opening 2*c* of the primary charger 2, i.e., is constituted so that an area of the heat generating portion is larger than an area of the primary charger opening and is formed in a curved shape along an outer peripheral surface of the photosensitive drum 1. More specifically, at least a width of the heater 21 with respect to a direction perpendicular to a longitudinal direction of the corona charger is wider than a width of the opening with respect to the same direction. The door-like heater 21 has such a door shape that a heat generating sheet using a PTC (positive temperature coefficient) heater disposed as specifically later discussed is extended and has rigidity to the extent that the door-like heater 21 cannot be bent as a whole during sliding drive in the heater frame 22. Herein, such a heater having an unbendable degree of rigidity is referred to as the "door-like heater" so as to be distinguished from a winding-up sheet-like heater described later but in the present invention, rigidity capable of withstanding the sliding drive suffices for the door-like heater. More specifically, as the door-like heater, it is possible to employ a constitution in which a sheet itself is provided with rigidity, a constitution in which a sheet is stretched on a frame, a constitution in which a lattice is applied as a framework, and the like.

At one end of the door-like heater 21 (at an end portion on an opening side with respect to an arrow X2 direction), a pressure-receiving plate 25 is fixed, and between the pressure-receiving plate 25 and the heater frame 22, a plurality of springs is provided in a contracted state. To the pressure-receiving plate, the sliding drive means is connected. As the sliding drive means, it is possible to use, e.g., actuators (of a hydraulic type a linear drive type, etc.) or motor mechanisms (an electronic motor, a rack-and-pinion mechanism, etc.). Further, to the sliding drive means, such a mechanism that a driving force is imparted with respect to the arrow X2 direction and driving connection is removed when the door-like heater 21 is moved in an arrow X1 direction may preferably be provided. As a result, the door-like heater 21 is moved and driven in the arrow X1 direction by an urging force by the springs 24.

In the above-described heat shielding apparatus 20, the portion between the opening 2*c* of the primary charger 2 and the surface 1*a* of the photosensitive drum 1 is shielded by the door-like heater 21 during non-image formation, i.e., at least a part of the heat generating portion is located between the opening and the image bearing member. In this embodiment, the shielding member shields the opening in such a manner that a width of the heat generating portion with respect to a direction perpendicular to the longitudinal direction of the corona charger is wider than a width of the opening with respect to the same direction. However, in the case where the width of the shielding portion is wider than the width of the heater portion, it is also possible to employ a constitution in which a part of the heater portion effects shielding.

On the other hand, during image formation, the door-like heater 21 is slidably moved in the arrow X2 direction along the heater frame 22 by the driving force imparted by the sliding drive means, i.e., the shielding member and the heat generating portion are integrally moved, so that an opening where the door-like heater is not present is provided with respect to the heater frame 22. In this case, the spring 24 are placed in the contracted state. As a result, the portion between the opening 2*c* of the primary charger 2 and the surface 1*a* of the photosensitive drum 1 is opened. Further, the door-like heater 21 is moved in contact with the electrode 23 shown in FIG. 3, so that the door-like heater 21 is capable of being supplied with electric power. During image formation, the primary charger 2 electrically charges the surface of the photosensitive drum 1 through the opening of the heat shielding apparatus, i.e., the opening provided with respect to the heater frame 22.

Next, the PTC heater will be described. The PTC heater is a heat generating member including a resistance layer having a large PTC (positive temperature coefficient). In this embodiment, as the door-like heater 21, a PTC heat generating resistor formed in a sheet-like shape is employed. A heat generating sheet using the PTC heater is described in JP-A Hei 06-295780 and JP-A 2003-109803.

When a voltage is applied to a PTC device, the PTC device itself generates heat by Joule heat and when a resultant temperature exceeds a Curie temperature (Tc), a resistance value is increased logarithmically. With the increase in resistance value, a current is decreased and an electric power (W) is suppressed, so that a heat generation temperature is lowered. Accordingly, when the resistance value is lowered, the current is increased and the electric power is increased again, so that the heat generation temperature is increased. By repeating this operation, the PTC device functions as a constant-temperature heat generating member. In this embodiment, a PTC resistor formed in a sheet-like shape is used as the PTC device. More specifically, as shown in FIG. 4, the door-like heater 21 as the PTC heater (device) is constituted by printing an expansion-contraction PTC resistor 21*a* on a structure consisting of a nonwoven fabric 21*d* and a flexible sheet 21*c* applied to the nonwoven fabric 21*d*, printing a heater electrode 21*b* on a structure consisting of a nonwoven fabric 21*d* and a flexible sheet 21*c* applied to the nonwoven fabric 21*d*, and laminating these structures.

In order to prevent the image flow by heating, it is necessary to increase a temperature of the surface 1*a* of the photosensitive drum 1 to 40° C. or more. For this reason, in this embodiment, the PTC heater 21 is set to have a surface temperature of, e.g., 50° C. and a voltage of, e.g., 100 V is applied to the PTC heater 21. As an experimental embodiment, changes in temperature and electric power are shown in FIG. 5. As shown in FIG. 5, a surface temperature A reaches 40° C. required for preventing the image flow in about 30 seconds and is thereafter stabilized at a set temperature of 50° C. Further, immediately after application of the voltage to the PTC resistor 21*a*, an inrush electric power is provided but is stabilized at a constant value in about 10 seconds.

An operation of the image forming apparatus in this embodiment will be described with reference to a time chart shown in FIGS. 6(*a*) and 6(*b*). In these figures, "STANDBY" means an image formable state and "IMAGE FORMATION" means a series of operations of pre-rotation performed before an image forming operation, the image forming operation, and post-rotation performed after the image forming operation. Further, "ENERGY SAVING MODE" means a state in which electric power is not supplied to the fixing apparatus. In the image forming apparatus in this embodiment, e.g., the surface temperature of the fixing roller during the standby state is kept at 200° C. The operation state is changed from the standby state to the energy saving mode state when a time for the standby state exceeds a set time.

As shown in FIG. 6(*a*), in the standby state of the image forming apparatus, the PTC heater 21 is turned on the basis of an instruction provided from an unshown control portion. For example, when an image forming signal is inputted into the control portion, the control portion makes a judgement on the image forming operation and outputs a drum rotation signal to a driving control portion of the drum driving apparatus constituting the photosensitive drum unit. After the output of the drum rotation signal, the control portion provides an instruction to the sliding drive means of the heat shielding apparatus 20 to slidably drive the PTC heater 21. More specifically, from the portion between the opening 2*c* of the primary charger 2 and the surface 1*a* of the photosensitive drum 1, the PTC heater 21 is slidably driven along the heater frame 22 to be placed in an opened state.

Then, the drive control portion of the drum driving apparatus provides an instruction to an unshown motor after a lapse of, e.g., 3 seconds from the input of the above-described image forming signal in view of an opening operation time of the PTC heater 21, i.e., in order to prevent electric discharge in the shielding state, thus starting a rotational drive of the photosensitive drum 1. Further, the control portion (charger control means) of the image forming apparatus starts an electrical charging or discharging operation of each of the chargers 2, 5, 6 and 7 after a lapse of, e.g., 3 seconds from the input of the image forming signal. That is, in a state in which the PTC heater 21 is completely opened, the image formation is started. In this embodiment, the sliding operation of the PTC heater 21 is performed by the drum rotation signal but it may also be performed by pressing-down of a copy start button or other signals such as a printer input signal and the like.

Thereafter, when the image formation (post-rotation) is completed, the driving connection between the sliding drive means and the PTC heater 21 is removed or broken, so that the PTC heater 21 shields and covers the opening 2*c* of the primary charger 2 by the urging force of the springs 24. In the above-described standby state and during image formation, the electric power is supplied to the PTC heater 21 on the basis of the instruction from the control portion regardless of the sliding drive of the PTC heater 21 to turn the heater on. The PTC heater 21 placed in the on-state reaches 40° C. in about 30 seconds and then reaches a constant set temperature of 50° C. by self-temperature control. As a result, decomposition of ozones generated during the image formation is accelerated and an occurrence of the image flow due to moisture absorption of the photosensitive drum 1 is prevented. When a set time from the completion of image formation elapses, a transfer from the standby state to the energy saving mode state is judged by the control portion, so that the PTC heater 21 is turned off.

Next, a control during a rise from the energy saving mode state or main switch (SW) off state, i.e., during warming-up will be described. As shown in FIG. 6(*b*), when the image forming apparatus rises from the energy saving mode state or main switch off state, a signal for effecting the rise to the image formable state by pushing-down of the main switch or the like is inputted into the control portion. The control portion judges a start of warming-up control and provides an instruction for turning the PTC heater 21 on to start electric power supply and at the same time, the control portion outputs the drum rotation signal to the driving control portion of the drum driving apparatus constituting the photosensitive drum unit to start the rotation of the photosensitive drum 1. As a result, the photosensitive drum 1 is placed in a heated state such that the photosensitive drum 1 is rotated for at least 20 seconds or more, preferably one full turn or more at a temperature of 40° C. with respect to the PTC heater 21. In the energy saving mode (during the main switch off state), the PTC heater 21 is located at the shielding position and the sliding operation of the PTC heater 21 is not performed as it is.

Next, when the control portion 100 judges completion of the heating of the photosensitive drum 1 and outputs a signal for completion of the drum heating, the sliding drive means of the heat shielding apparatus 20 sliding-drives the PTC heater 21 by receiving the outputted signal. Similarly as in the above-described operation, in order to prevent the electrical discharge in the shielding state, the control portion provides an instruction to the primary charger 2 after a lapse of, e.g., 3 seconds from the input of the signal to start electric potential control of the photosensitive drum 1 in a state in which the portion between the opening 2*c* of the primary charger 2 and the surface 1*a* of the photosensitive drum 1 is completely opened. Thereafter, when the potential control is completed, by an instruction from the control portion, the image forming apparatus is placed in the above-described standby state (FIG. 6(*a*)). In the case where the image formation is performed immediately after the completion of the potential control, the image forming apparatus is placed in the image forming state shown in FIG. 6(*a*) while the PTC heater 21 is kept in the opened state.

As described above, in the image forming apparatus which is not used for a long time, electric power supply to the PTC heater 21 is stopped for the time but the portion between the opening 2*c* of the primary charger 2 and the surface 1*a* of the photosensitive drum 1 is shielded, so that it is possible to suppress the occurrence of the image flow. When the image forming apparatus is placed in a state in which it is left standing for a long time in a high humidity condition, the surface of the photosensitive drum 1 particularly at a portion opposing each of the openings 5*c*, 6*c* and 7*c* of the pre-transfer charger 5, the transfer charger 6, and the separation charger 7 is liable to absorb moisture. However, the image forming apparatus in this embodiment is capable of drying the surface 1*a* of the photosensitive drum 1 even after it is left standing for a long time in the high humidity condition by causing the PTC heater 21 to generate heat during the rise of the PTC heater 21 to heat the surface 1*a* of the photosensitive drum 1 in a rotation state.

In the image forming apparatus of this embodiment, it was possible to obtain a good image from an initial stage of rise after the long-time standing in the high-humidity environment. By employing internal heating in combination at the same time, it is possible to prevent the occurrence of the image flow in a shorter time.

According to the image forming apparatus of this embodiment, it is possible to not only reduce the amount of electric discharge products deposited on the photosensitive drum 1 but also concentratedly heat the surface of the photosensitive drum 1 at the portion, required to be heated, opposing the corona charger. Further, e.g., without additionally providing a heating roller or the like in a peripheral area of the photosensitive drum 1, it is possible to shield and open the corona charger with a compact constitution and also to dry the surface of the photosensitive drum 1. That is, with the compact constitution as described above, it is possible to prevent image formation failure such as an occurrence of the image flow or the like even in, e.g., the high-humidity environment.

Second Embodiment

Figure 7:
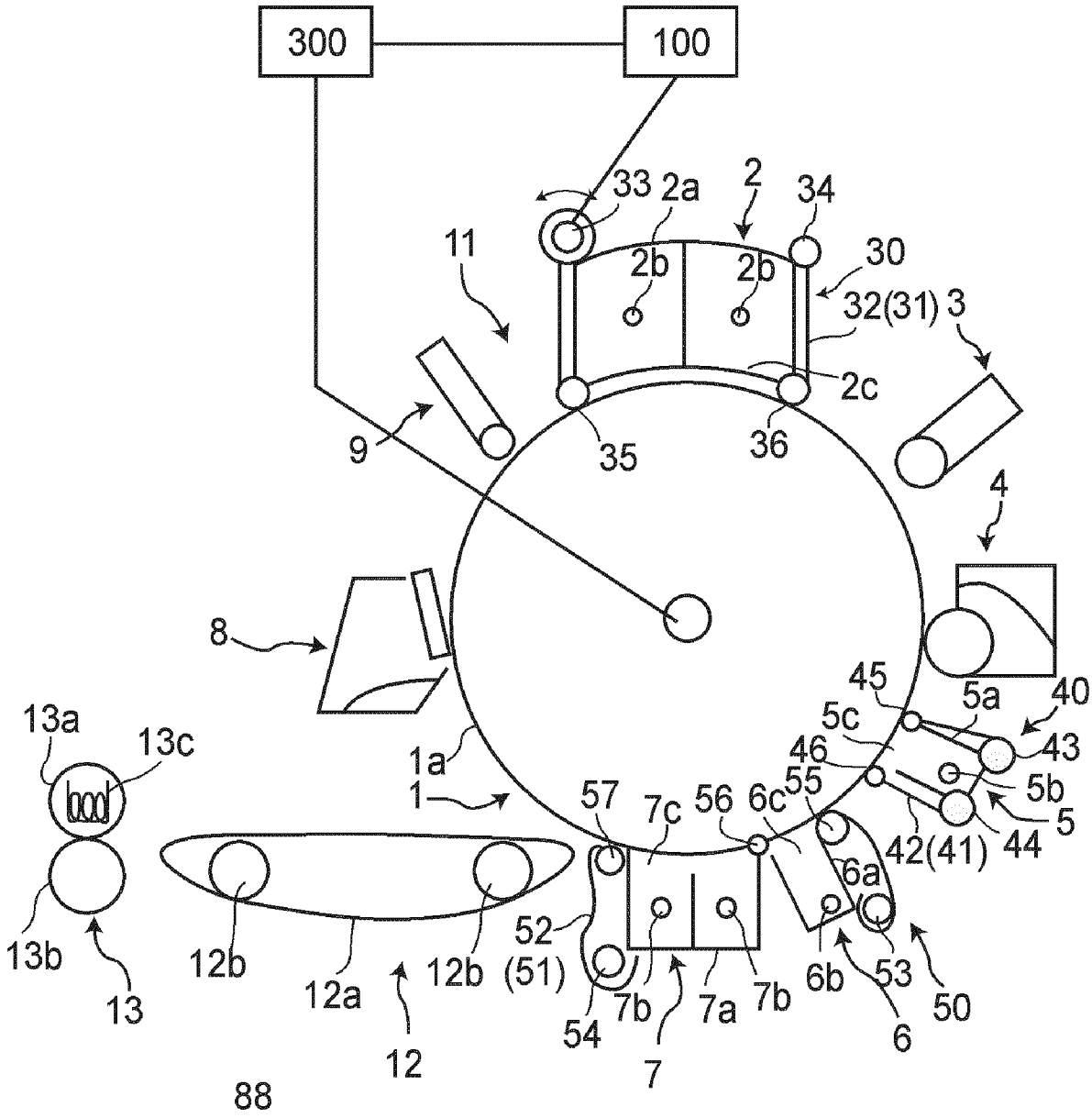
FIG. 7 is a schematic sectional view showing an image forming apparatus according to a Second Embodiment of the present invention.
Figure 8:
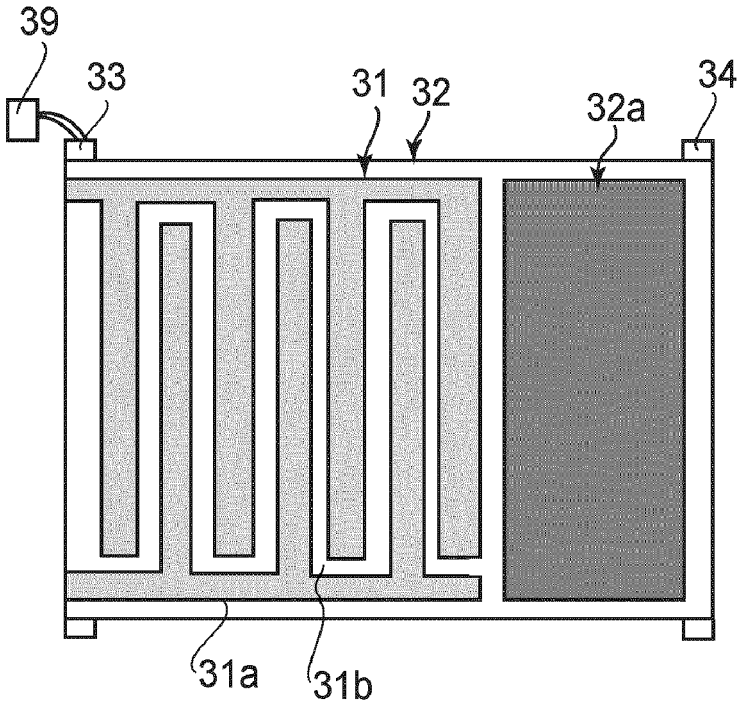
FIG. 8 is a schematic development showing a heat shielding apparatus according to the Second Embodiment.

The Second Embodiment of the present invention which is partially changed in the constitution of the First Embodiment will now be described with reference to FIGS. 7 and 8. FIG. 7 is a schematic sectional view of an image forming apparatus according to this embodiment, and FIG. 8 is a schematic development of a heat shielding apparatus according to this embodiment. In this embodiment, members or portions identical or similar to those in the First Embodiment described above are represented by identical reference numerals or symbols and a redundant explanation thereof will be omitted.

In the image forming apparatus of this embodiment, as shown in FIG. 7, a heat shielding apparatus 30 is provided to a primary charger 2 and a heat shielding apparatus 40 is provided to a pre-transfer charger 5. Further, a heat shielding apparatus 50 is provided to a transfer charger 6 and a separation charger 7.

The heat shielding apparatus (shielding member driving apparatus) 30 is constituted by a stretching sheet 32 including a sheet-like heater 31 and an opening 32*a*, guide rollers 35 and 36, and winding-up shafts (means) 33 and 34. Further, the heat shielding apparatus (shielding member driving apparatus) 40 is constituted by a stretching sheet 42 including a sheet-like heater 41 and an unshown opening, guide rollers 45 and 46, and winding-up shafts (means) 43 and 44.

The winding-up shaft 33 is controlled by a control portion for controlling a rotational driving portion 300 of a photosensitive drum 1.

Further, the heat shielding apparatus (shielding member driving apparatus) 50 is constituted by a stretching sheet 52 including a sheet-like heater 51 and an unshown opening, guide rollers 55, 56 and 57, and winding-up shafts (means) 53 and 54.

These heat shielding apparatuses 30, 40 and 50 have the substantially same constitution except that the guide roller 56 (single guide roller) is disposed between the two chargers 6 and 7 which are covered with the (single) stretching sheet 52. For this reason, in the following description, basically, the heat shielding apparatus 30 will be described and the heat shielding apparatuses 40 and 50 will be omitted from explanation.

The winding-up shafts 33 and 34 of the heat shielding apparatus 30 are rotatably positioned and supported at two side end portions of a shield 2*a* of the primary charger 2 located apart from a surface 1*a* of the photosensitive drum 1. The winding-up shaft 34 is urged in a rotational direction for always winding up the stretching sheet 32 by an urging means such as a spring or the like contained therein. Further, the winding-up shaft 33 contains therein a rotatable motor and winds up the stretching sheet 32 against an urging force of the winding-up shaft 34 by an instruction (for supplying electric power) from a controller unit 100.

The stretching sheet 32 has an opening 32*a* formed in the substantially same size as (or a size larger than) a size of the opening 2*a* of the primary charger 2 and is constituted by the sheet-like heater (PTC heater) 31. At least a width of the PTC heater 31 with respect to a direction perpendicular to a longitudinal direction of the corona charger is wider than a width of the opening, so that in this embodiment, an area of the PTC heater 31 is larger than an area of the opening of the corona charger. The PTC heater 31 in this embodiment has a comb-like electrode 31*b* in order to minimize non-uniformity in heat generation, so that electric power can be supplied to a PTC resistor 31*a* by the comb-like electrode 31*b*.

The guide rollers 35 and 36 are rotatably disposed at portions close to both ends of the opening 2*c* as shown in FIG. 7. Further, the guide rollers 35 and 36 can be moved and driven in directions in which their rotational shafts are moved close to and apart from the surface 1*a* of the photosensitive drum 1 by an unshown cam driving mechanism (roller moving means). As the guide rollers 35 and 36, a material having a low surface frictional force may preferably be used.

Accordingly, the stretching sheet 32 (the PTC heater 31) is stretched by the winding-up shafts 33 and 34 and the guide rollers 35 and 36 so as to cover three surface portions of the primary charger 2. Further, during a non-image formation period in which image formation is not performed, a portion between the opening 2*c* of the primary charger 2 and the surface 1*a* of the photosensitive drum 1 is shielded by a portion of the PTC heater 31. In other words, at least a part of a heat generating portion is located between the opening and the image bearing member. Further, the stretching sheet 32 (the PTC heater 31) can be driven for movement toward and away from the surface 1*a* of the photosensitive drum 1 by the cam driving mechanism for the guide rollers 35 and 36.

During image formation, the winding-up shaft 33 is driven so that the opening 32*a* is located at the opening 2*a* by an instruction from the controller unit 100 on the basis of an instruction from the control portion of the image forming apparatus. As a result, the PTC heater 31 which shields the portion between the opening 2*a* of the primary charger 2 and the surface 1*a* of the photosensitive drum 1 is moved (the shielding member and the heat generating portion are integrally moved), i.e., placed in an opened state, so that it is possible to electrically charge the photosensitive drum 1 by the primary charger 2. Incidentally, similarly as in the First Embodiment, the control portion 100 of the image forming apparatus starts control of the rotational driving portion 300 of the photosensitive drum 1 after a lapse of, e.g., 3 seconds from the input of the image forming signal and also starts an operation for electrically charging or discharging each of the chargers 2, 5, 6 and 7.

Figure 9:
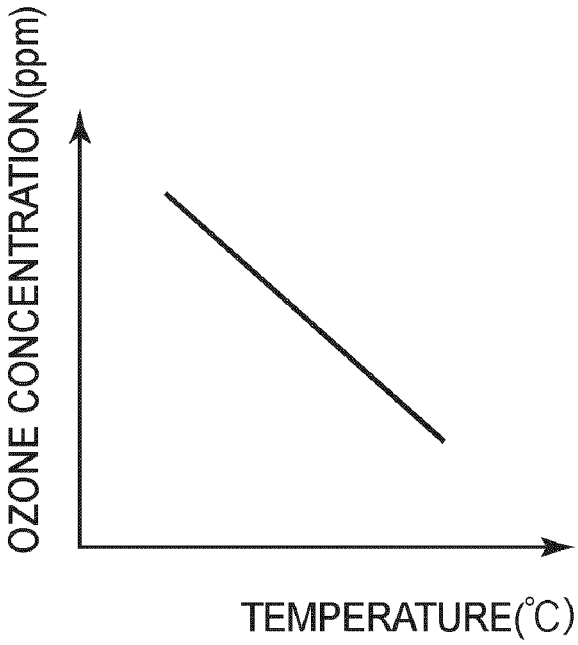
FIG. 9 is a graph showing a relationship between an ozone concentration and temperature.

Further, by covering the side surfaces of the shield 2*a* of the primary charger 2 with the stretching sheet 32, it is possible to heat the primary charger 2 even in a state in which the portion between the opening 2*a* of the primary charger 2 and the surface 1*a* of the photosensitive drum 1 is opened. The heating of the charger during image formation promotes an effect of decomposing the generated ozones. Incidentally, JP-A Hei 06-167857 has disclosed a constitution of self-decomposition of ozones by blowing warm air of a fixing device to a corona charger. FIG. 9 is a graph showing a relationship between ozone concentration and temperature. As shown in FIG. 9, it is understood that the ozone concentration is decreased with increasing temperature.

After the image formation, the portion having the opening 32*a* of the stretching sheet 32 is wound up in a direction toward the winding-up shaft 34, so that the PTC heater 31 shields the portion between the opening 2*a* of the primary charger 2 and the surface 1*a* of the photosensitive drum 1. In other words, the PTC heater 31 functions as a shielding member for preventing corona discharge products from depositing on the photosensitive drum 1 in a stopped state during standby, so that it is possible to obtain a good image free from the image flow. In this case, the guide rollers 35 and 36 are moved in a direction in which they are moved apart from the surface 1*a* of the photosensitive drum 1.

During the warming-up control described above, the guide rollers 35 and 36 are moved in a direction in which they are moved close to the surface 1*a* of the photosensitive drum 1, so that the PTC heater 31 is caused to contact the surface 1*a* of the photosensitive drum 1. As a result, during the warming-up control, it is possible to quickly heat the surface 1*a* of the photosensitive drum 1.

Further, by proving not only the heat shielding apparatus 30 with respect to the primary charger 2 but also the similarly constituted heat shielding apparatuses 40 and 50 with respect to the pre-transfer charger 5, and the transfer charger 6 and the separation charger 7, it was possible to obtain a good image from a time immediately after the rise of the image forming apparatus even after the image forming apparatus was left standing for a long time in the high-humidity environment. In this embodiment, compared with the image forming apparatus of the First Embodiment, it is possible to dry the surface 1*a* of the photosensitive drum 1 in a shorter time.

According to the image forming apparatus of this embodiment, similarly as in the First Embodiment, it is possible to not only reduce the amount of electric discharge products deposited on the photosensitive drum 1 but also concentratedly heat the surface of the photosensitive drum 1 at the portion, required to be heated, opposing the corona charger. Further, e.g., without additionally providing a heating roller or the like in a peripheral area of the photosensitive drum 1, it is possible to shield and open the corona charger with a compact constitution and also to dry the surface of the photosensitive drum 1. That is, with the compact constitution as described above, it is possible to prevent image formation failure such as an occurrence of the image flow or the like even in, e.g., a high-humidity environment.

Third Embodiment

Figure 10:
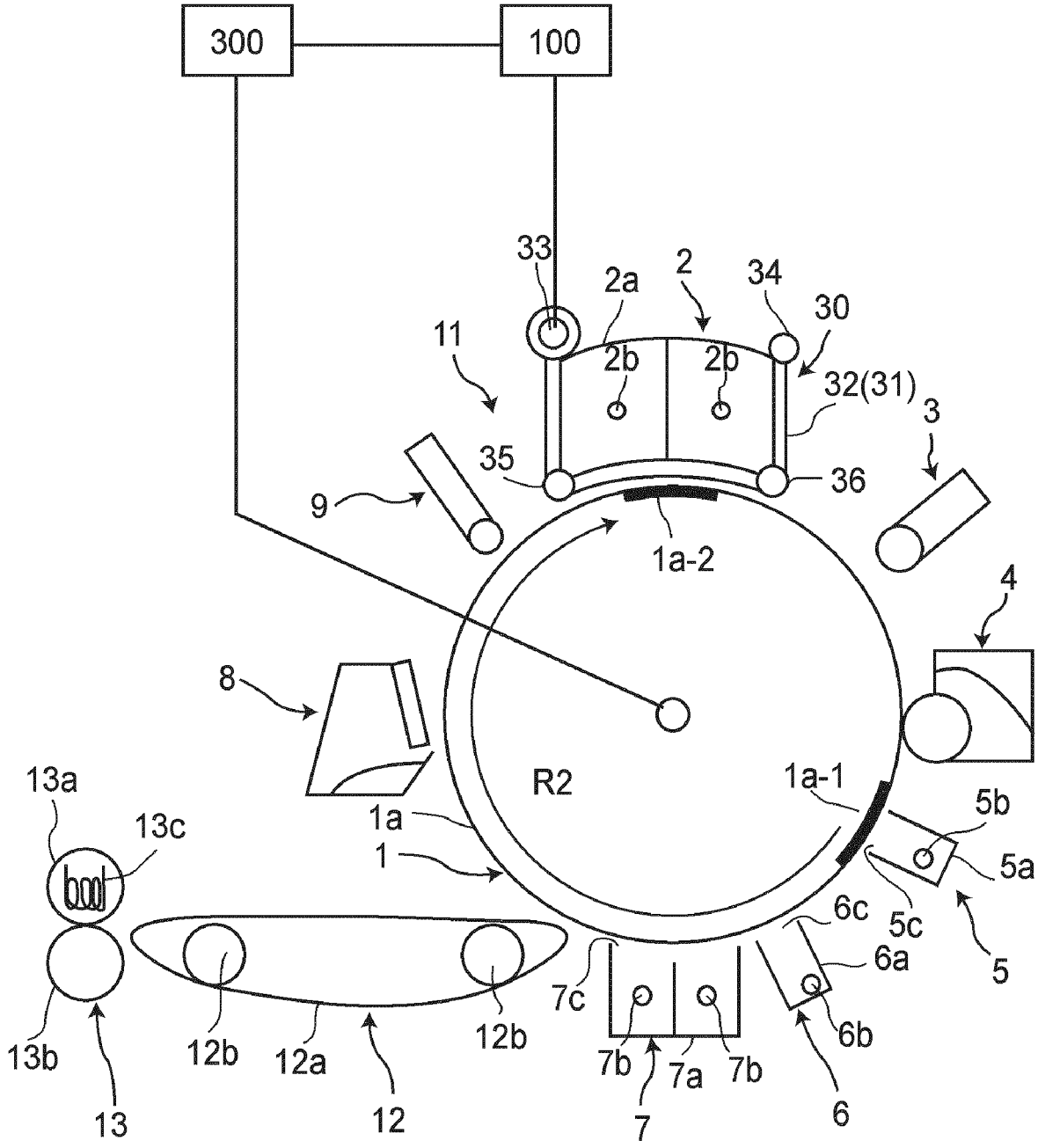
FIG. 10 is a schematic sectional view showing an image forming apparatus according to a Third Embodiment of the present invention.

A Third Embodiment of the present invention which is partially changed in the constitution of the Second Embodiment will be described with reference to FIG. 10. FIG. 10 is a schematic sectional view of an image forming apparatus according to this embodiment. In this embodiment, members or portions identical or similar to those in the First Embodiment and the Second Embodiment described above are represented by identical reference numerals or symbols and redundant explanation thereof will be omitted.

In the image forming apparatus of this embodiment, as shown in FIG. 10, a heat shielding apparatus (shielding member driving apparatus) 30 is provided to a primary charger 2 but no heat shielding apparatus is provided to a pre-transfer charger 5, a transfer charger 6, and a separation charger 7.

In the image forming apparatus of this embodiment, in the case where the image forming apparatus in the standby state in which it is left standing for a long time in a high-humidity environment is restored to the image forming state, there is a possibility of deposition of corona discharge products on the surface 1*a* of the photosensitive drum 1 particularly at portions opposing the pre-transfer charger 5, the transfer charger 6, and the separation charger 7. For this reason, these portions are controlled to be locally heated.

In the image forming apparatus of this embodiment, during the warming-up control, the PTC heater 31 is brought into contact with the surface 1*a* of the photosensitive drum 1 by the guide rollers 35 and 36. On the basis of an instruction from the control portion, the photosensitive drum 1 is rotationally-controlled in the arrow R2 direction, and the portions of the photosensitive drum 1 opposing the separation charger 7, the transfer charger 6, and the pre-transfer charger 5 are successively stopped and heated for, e.g., 10 seconds (for each charger) in this order during the standby period.

For example, referring to FIG. 10, when a position 1*a*-1 of the surface 1*a* of the photosensitive drum 1 opposing the pre-transfer charger 5 during the standby period is rotated in the arrow R2 direction to reach a position 1*a*-2 opposing the primary charger 2, the photosensitive drum 1 is stopped for, e.g., 10 seconds. By such an operation, it is possible to completely prevent the occurrence of the image flow, so that a good image can be obtained from a time immediately after the rise of the image forming apparatus even after the long-time standing in the high-humidity environment.

As described above, according to the image forming apparatus of this embodiment, similarly as in the above-described embodiments, it is possible to not only reduce the amount of the discharge products deposited on the photosensitive drum 1 but also concentratedly heat the portions on the surface 1*a* of the photosensitive drum 1 opposing the corona chargers required to be heated. Further, with a more compact constitution such that only one shielding member having a heat generating portion is provided, it is possible to prevent the occurrence of image formation failure such as the image flow. Incidentally, in this embodiment, the constitution in which each of the portions which are considered as, e.g., position where much moisture absorption is caused by the deposition of the corona discharge products is dried by stopping the photosensitive drum 1 for, e.g., 10 seconds is described. It is also possible to effect rotation control such that the rotational speed of the photosensitive drum 1 is lowered during the passage thereof at each of the above described portions.

Fourth Embodiment

Figure 11:
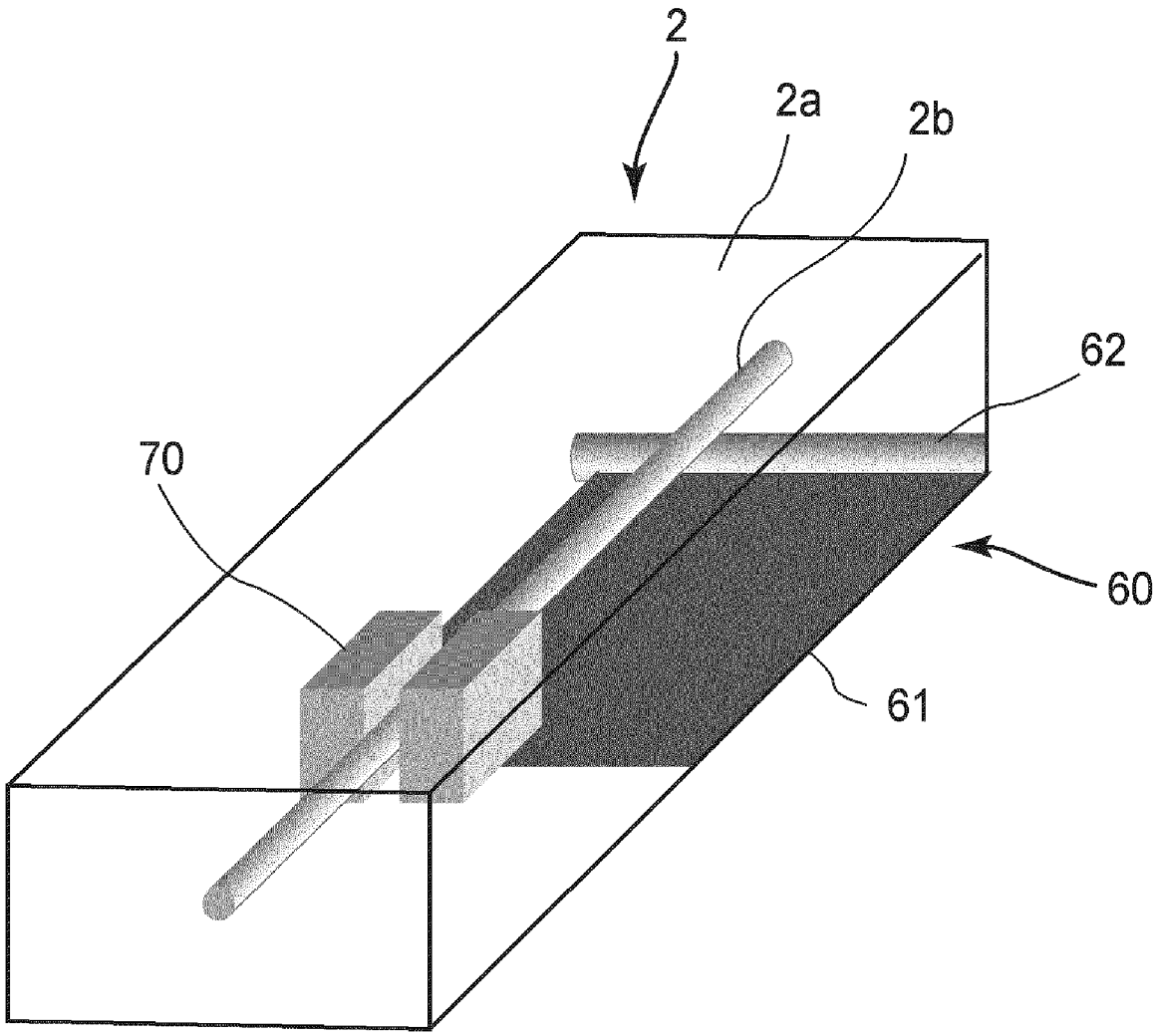
FIG. 11 is a schematic perspective view showing a primary charger and a heat shielding apparatus according to a Fourth Embodiment.
Figure 12:
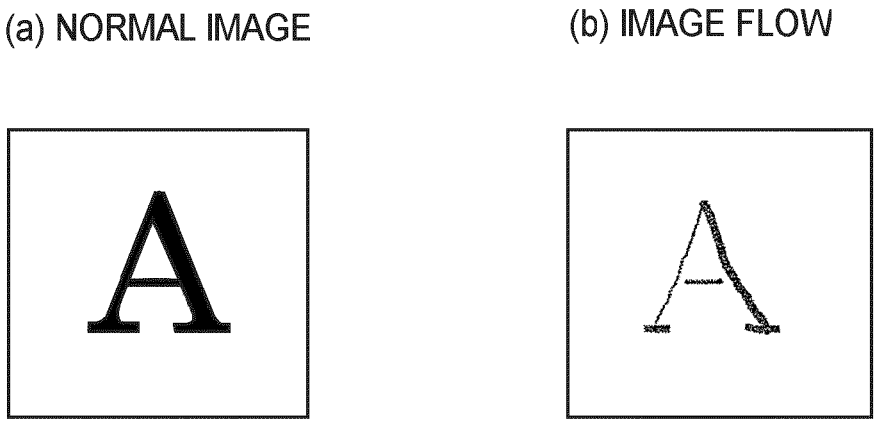
FIGS. 12(*a*) and 12(*b*) are schematic views for illustrating an image flow, wherein FIG. 12(*a*) shows a state of a normal image and FIG. 12(*b*) shows a state of the image flow.
Figure 13:
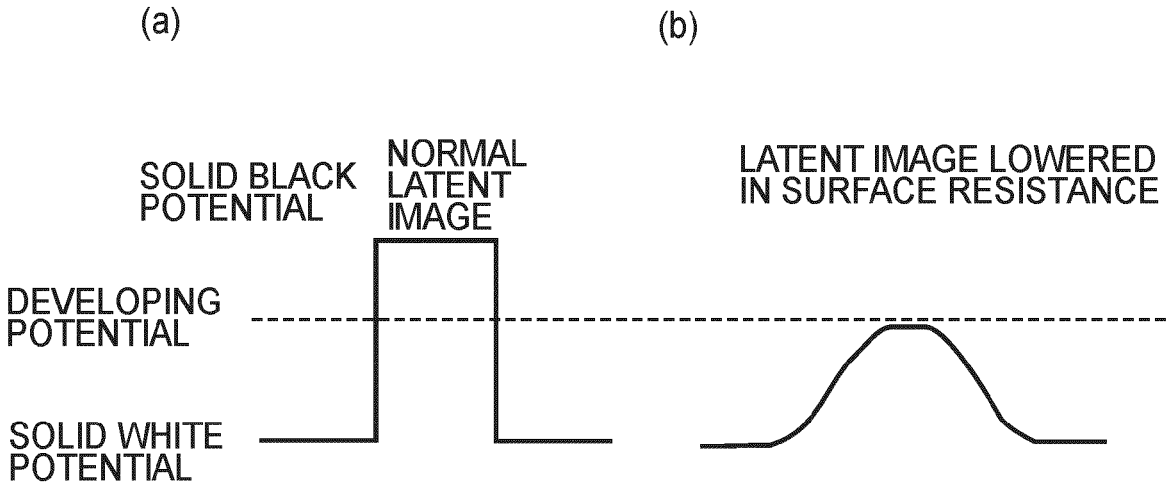
FIGS. 13(*a*) and 13(*b*) are schematic views for illustrating states of latent images varying depending on an electric potential of a photosensitive member, wherein FIG. 13(*a*) shows an electric potential of a normal latent image and FIG. 13(*b*) shows an electric potential of a latent image lowered in surface resistance.

A Fourth Embodiment of the present invention which is partially changed in the constitution of the Third Embodiment will be described with reference to FIG. 11. FIG. 11 is a schematic perspective view of a primary charger and a heat shielding apparatus according to this embodiment. In this embodiment, members or portions identical or similar to those found in the First Embodiment to the Third Embodiment described above are represented by identical reference numerals or symbols and a redundant explanation thereof will be omitted.

The image forming apparatus according to this embodiment includes a cleaning apparatus for cleaning a wire electrode 2*b* of a primary charger 2. As described above, the corona discharge products produced by electric discharge are deposited not only on the photosensitive drum 1 but also on the shield and the wire electrode of the charging device. Particularly, in the case of the deposition on the wire electrode, there is a possibility of an occurrence of electric charge non-uniformity caused by a difference in surface resistance. For this reason, as the cleaning apparatus, a cleaning member 70 movable in contact with the wire electrode 2*b* and an unshown cleaning member driving means for moving and driving the cleaning member 70 along the wire electrode 2*b* are provided. As the cleaning member driving means, it is possible to use a driving motor, a rack-and-pinion mechanism, etc.

A heat shielding apparatus (shielding member driving apparatus) 60 includes a sheet-like heater (PTC heater) 61 and a winding-up shaft 62 having an urging means for urging the PTC heater 61 in a direction in which the PTC heater 61 is always wound up. An end portion, of the PTC heater 61, opposite from the winding-up shaft 62 is connected to the cleaning apparatus 70 by, e.g., a screw, an adhesive, or the like. At least a width of the PTC heater 61 with respect to a direction perpendicular to a longitudinal direction of the corona charger is wider than a width of the opening, so that in this embodiment, an area of the PTC heater 61 is larger than an area of the opening of the corona charger.

Further, during a non-image formation period in which image formation is not performed, a portion between the opening of the primary charger 2 and the surface of the photosensitive drum 1 is shielded by a portion of the PTC heater 61. In other words, at least a part of a heat generating portion is located between the opening and the image bearing member.

During image formation, the cleaning member 70 is moved and driven in a direction toward the winding-up shaft 62 by the cleaning member driving means, so that the PTC heater 61 is wound up by the winding-up shaft 62. As a result, the PTC heater 61 is retracted from the portion between the opening 2*c* of the primary charger 2 and the surface 1*a* of the photosensitive drum 1 is moved (the shielding member and the heat generating portion are integrally moved). That is, the primary charger 2 is placed in an opened state. Incidentally, in the case where the cleaning of the wire electrode 2*b* is required particularly in a period other than the image forming period, the primary charger 2 is placed in the opened state but an opened time is very small, so that the cleaning operation may be performed by moving and driving the cleaning member 70. After completion of the cleaning operation, the cleaning member 70 is moved and driven in a direction opposite from the direction toward the winding-up shaft 62. That is, the primary charger 2 is shielded.

Further, during the warming-up control, similarly as in the Third Embodiment, the photosensitive drum 1 is rotationally controlled so that another portion of the surface thereof opposing another corona charger can be locally heated. By this operation, it is possible to completely prevent the occurrence of the image flow, and a good image can be obtained from a time immediately after the rise of the image forming apparatus to even after a long standing time in the high-humidity environment. In the case where other corona chargers are provided with the above-described cleaning apparatus, it is also possible to provide the heat shielding apparatus to these corona chargers with the same constitution. In this case, similarly as in the Second Embodiment, it is possible to dry the surface 1*a* of the photosensitive drum 1 in a shorter time than those in the First Embodiment and the Third Embodiment.

As described above, according to the image forming apparatus of this embodiment, similarly as in the above-described embodiments, it is possible not only to reduce the amount of the discharge products deposited on the photosensitive drum 1 but also to concentratedly heat the portions no the surface 1*a* of the photosensitive drum 1 opposing the corona chargers required to be heated. Further, with a more compact constitution such that only one shielding member having a heat generating portion is provided, it is possible to prevent the occurrence of image formation failure such as the image flow.

Incidentally, in the First to the Fourth Embodiments described above, the constitution employing the corona charger as the primary charger, the pre-transfer charger, the transfer charger, and the separation charger is described. However, the chargers can be effectively used in the present invention so long as any one of the chargers is the corona charger.

Further, in the above-described embodiments, the constitution employing the PTC heater as the heat generating portion of the shielding member is described but the present invention is not limited thereto. Any heating means may be used so long as it can heat the photosensitive drum. For example, it is also possible to means for performing temperature control of a heating wire by a thermostat or the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 221001/2006 filed Aug. 14, 2006 which is hereby incorporated by reference.

What is claimed is:

1. An image forming apparatus comprising:

a photosensitive member;

a corona charger configured to electrically charge said photosensitive member to form an electrostatic image on said photosensitive member;

a heater configured to heat said photosensitive member and being disposed at a position between said photosensitive member and said corona charger; and a retracting mechanism configured to retract said heater from the position between said photosensitive member and said corona charger during an image formation process.

2. An image forming apparatus according to claim 1, wherein said retracting mechanism includes a shielding member configured to open and close an opening of said corona charger and being disposed so as to face said photosensitive member, and wherein said heater is fixed to said shielding member.

* * * * *